United States Patent [19]

Carpenter, Jr.

[11] Patent Number: 4,680,898

[45] Date of Patent: Jul. 21, 1987

[54] METHOD AND APPARATUS FOR CLEANING WORKPIECES

[76] Inventor: James H. Carpenter, Jr., 212 Pangborn Blvd., Hagerstown, Md. 21740

[21] Appl. No.: 716,926

[22] Filed: Apr. 1, 1985

Related U.S. Application Data

[63] Continuation-in-part of Ser. No. 602,614, Apr. 20, 1984.

[51] Int. Cl.[4] ..... B24C 3/08

[52] U.S. Cl. ..... 51/419; 51/423

[58] Field of Search ..... 51/417, 420, 423, 422, 51/419, 313, 319; 134/144; 198/215

[56] References Cited

U.S. PATENT DOCUMENTS

| | | | |
|---|---|---|---|
| 2,613,036 | 10/1952 | Robinson | 51/164.1 |
| 2,734,316 | 2/1956 | Dawson | 51/164.1 |
| 3,626,641 | 12/1971 | Powell | 51/420 |
| 3,748,787 | 7/1973 | Carpenter et al. | 51/420 |
| 3,852,919 | 12/1974 | Baughman et al. | 51/419 |
| 3,903,652 | 9/1975 | Baughman et al. | 51/420 |
| 4,001,976 | 1/1977 | MacMillan | 51/418 |
| 4,077,166 | 3/1978 | Vrana | 51/420 |
| 4,319,624 | 3/1982 | Weis et al. | 164/401 |

FOREIGN PATENT DOCUMENTS

| | | | |
|---|---|---|---|
| 3210699 | 11/1982 | Fed. Rep. of Germany . | |
| 0143956 | 8/1983 | Japan | 51/319 |
| 1478887 | 7/1977 | United Kingdom . | |

OTHER PUBLICATIONS

"Flat Stroke Shaker Conveyor", promotional brochure, Goodman.

Sisson-Lehmann, Jun. 22-28, 1984, foreign promotional literature.

*Primary Examiner*—Frederick R. Schmidt

*Assistant Examiner*—Robert A. Rose

*Attorney, Agent, or Firm*—Wayne D. Porter, Jr.

[57] ABSTRACT

Workpieces such as sand-casted automobile engine blocks are cleaned by advancing a series of such workpieces axially into one end of an elongate barrel that holds the workpieces and rotates or tumbles them in the path of impinging streams of particles. The workpieces are advanced from one end of the barrel to the other by oscillating the barrel along the longitudinal axis of the barrel. By this technique, workpieces can be advanced through the barrel without the need to push the workpieces against each other, or without the need to provide workpiece-engaging and advancing mechanisms.

26 Claims, 18 Drawing Figures

METHOD AND APPARATUS FOR CLEANING WORKPIECES

This is a continuation-in-part application of U.S. patent application Ser. No. 602,614, filed Apr. 20, 1984, by James H. Carpenter, Jr.

CROSS-REFERENCE TO RELATED PATENTS

1 "Continuous Cleaning Apparatus", U.S. Pat. No. 3,903,652, issued Sept. 9, 1975 to D. L. Baughman and J. H. Carpenter, Jr., here, the "Axi-Flow Patent", the disclosure of which is incorporated herein by reference.

2. "Continuous Cleaning Apparatus", U.S. Pat. No. 3,852,919, issued Dec. 10, 1974 to D. L. Baughman and J. H. Carpenter, Jr., here the "Axi-Flow Feeder Patent", the disclosure of which is incorporated herein by reference.

3. "Continuous Cleaning Apparatus", U.S. Pat. No. 3,626,641, issued Dec. 14, 1971 to G. W. Powell, W. J. Harper and J. H. Carpenter, Jr., here the "Trans-Bar Machine Patent", the disclosure of which is incorporated herein by reference.

4. "Workpiece Treating Apparatus", U.S. Pat. No. 3,748,787, issued July 31, 1973 to J. H. Carpenter, Jr. and H. W. Good, here the "Uni-Bar Machine Patent", the disclosure of which is incorporated herein by reference.

BACKGROUND OF THE INVENTION

2. Field of the Invention

The invention relates to a method and apparatus for cleaning workpieces such as sand-casted automobile engine blocks, and more particularly, to such a method and apparatus wherein workpieces are advanced past a cleaning station by means of an oscillating mechanism.

3. Description of the Prior Art

After automobile engine heads, manifolds, blocks, or like articles have been sand-casted, it is necessary to remove remaining traces of sand, scale, and other debris in order to perform further work operations on the parts. A particularly effective apparatus for cleaning such parts (hereafter referred to for convenience as "workpieces") is set forth in the Axi-Flow Patent. In the Axi-Flow Patent, workpieces are advanced successively through an elongate barrel having a skeletal wall construction open at both ends. The barrel is long enough to permit the longitudinal passage of a single line of workpieces through the barrel. As workpieces are advanced through the barrel, the barrel is rotated. A plurality of abrasive throwing wheels are positioned adjacent the barrel to project abrasive particles at high speed through the skeletal walls onto workpieces being advanced through the barrel. By appropriate control of the speed of travel of the workpieces through the barrel, and by rotating the barrel at appropriate speeds (or not rotating it at certain times), almost all surfaces of the workpieces can be cleaned quite effectively. Production rates are very flexible, with an upper limit on the order of 800–1200 workpieces per hour.

Although the Axi-Flow Patent provides an exceedingly effective workpiece cleaning apparatus, certain problems remain. One of these problems relates to cleaning the ends of the workpieces. In the Axi-Flow Patent, a conveyer is provided to deliver workpieces sequentially to the feed end of the barrel. A pusher is provided to push individual workpieces into the barrel and against preceding workpieces such that the line of workpieces in the barrel is in end-to-end contact. Although the Axi-Flow Patent sets forth several techniques by which the ends of workpieces could be cleaned better, such as by casting spacers in place at the ends of the castings or by orienting alternate workpieces at right angles to adjacent workpieces, no totally effective automatic technique is available to clean the ends of the workpieces. The Axi-Flow Feeder Patent, although providing an effective technique for presenting workpieces to the feed end of the barrel, still does not address the problem of cleaning the ends of the workpieces.

An additional concern not addressed by the Axi-Flow Patent and the Axi-Flow Feeder Patent is that of the size and configuration of the workpieces that can be advanced through the barrel. That is, it is necessary for the barrel to be carefully sized relative to the workpieces in order to prevent jamming of the workpieces as they are pushed through the barrel. If it is attempted to provide a larger barrel in order to handle differently sized workpieces, jamming can occur. Jamming is thought to occur through skewing of one or more workpieces relative to the longitudinal axis of the barrel or through two workpieces being wedged tightly together so as to block the barrel. Although the Axi-Flow Patent and the Axi-Flow Feeder Patent set forth machines which operate effectively to clean workpieces at a high rate of speed, these machines lack a certain degree of versatility. The capability to accommodate differently sized workpieces can be obtained only by providing a variety of barrels that relatively closely conform to the configuration of the workpieces, or by providing barrels that have adjustable components.

The Trans-Bar Machine Patent and the Uni-Bar Machine Patent represent two attempts to solve the previously referenced problem of spacing the workpieces in the barrel such that the ends of the workpieces can be cleaned properly. Both the Trans-Bar Machine Patent and the Uni-Bar Machine Patent employ mechanisms which extend into the barrel to engage the workpieces and advance the workpieces through the barrel. The engaging and advancing mechanisms are operated such that a certain spacing of the workpieces occurs. As the workpieces are advanced through the barrel, the mechanisms successively are moved relative to the workpieces in order to engage succeeding workpieces and advance the succeeding workpieces through the barrel.

Because the Trans-Bar Machine Patent and the Uni-Bar Machine Patent cause the workpieces to be spaced during their passage through the barrel, automatically cleaning the ends of the workpieces no longer is a problem. Unfortunately, the production capability of these machines is less than that of the Axi-Flow Patent due to the time required to perform all of the mechanism motions. Accordingly, the Trans-Bar Machine Patent and the Uni-Bar Machine Patent are limited to approximately 600–800 parts per hour versus approximately 800–1200 parts per hour for the Axi-Flow Patent. Moreover, the very existence of mechanisms which extend into the barrel and are impinged by abrasive particles creates a maintenance problem. Additionally, the Trans-Bar Machine patent and the Uni-Bar Machine Patent do not address the problem associated with jamming workpieces in the barrel where the workpieces are not closely sized relative to the barrel.

One device is known wherein workpieces are passed through a cleaning apparatus without the need for pushing the workpieces end-to-end or without providing workpiece engaging and advancing mechanisms. The device in question employs a vibratory conveyor having longitudinally extending frame members which closely conform to the cross-sectional dimensions of the workpieces. In order to orient the workpieces at different attitudes relative to abrasive particle throwing wheels, different sections of the frame members are oriented at different fixed positions relative to the throwing wheels. The type of vibratory drive provided for the conveyor subjects the workpieces to a jolting action in an attempt to cause sand to be loosened and drained from intricate passages or cores in the workpieces.

Unfortunately, the device in question is not as effective as desired. The use of frame members fixed in position relative to the throwing wheels does not provide the same flexibility as does a rotating barrel construction. In effect, it is more difficult to direct abrasive material onto all surfaces of the workpieces. Moreover, because the frame members closely conform to the cross-sectional configuration of the workpieces, the possibility of jamming still exists. The device lacks the capability to accept workpieces of different sizes. Additionally, the jolting action to which the workpieces are subjected is not thought to be effective in loosening and draining sand and scale from internal passages.

Other devices are known wherein workpieces are passed through a cleaning apparatus without the need for pushing the workpieces end-to-end or without providing workpiece engaging and advancing mechanisms. The referenced devices operate much like barrel tumblers and employ a trough-like barrel having a top opening and openings at each end. The barrel is inclined relative to the horizontal so that the feed end is higher than the exit end. The barrel is oscillated about a longitudinal axis while workpieces are deposited into the feed end and abrasive particles are blasted through the top opening. This arrangement is effective because the abrasive particles are blasted directly onto the workpieces without having some of the particles impinge intervening portions of the barrel.

Despite the advantage of the referenced devices in avoiding blasting portions of the barrel, certain problems remain. Because the bed depth and the horizontal slope of the barrel are important factors in how fast workpieces can be advanced through the barrel, and because these factors are constant for a given machine, the referenced devices cannot readily be adjusted for different desired production rates. Further, the referenced devices cannot accurately control the axial speed of a single line of workpieces, in part because workpieces can tumble axially as they advance through the barrel. Additionally, the bed depth of the barrel is such that workpieces can be buried under other workpieces and thereby shielded from the blast. In those cases where it is desired to change the type of workpieces being cleaned in the barrel, it is necessary to shut down the referenced devices in order to remove workpieces remaining at the bottom of the barrel; this is caused by the failure of the referenced devices to provide a positive drive for advancing workpieces through the barrel.

SUMMARY OF THE INVENTION

In response to the foregoing considerations, the present invention provides a new and improved method and apparatus for cleaning workpieces wherein the workpieces are advanced past a cleaning station and are spaced from each other without employing workpiece-contacting advancing mechanisms. The present invention enables a wide range of workpiece sizes to be used without causing the jamming problems associated with prior workpiece cleaning apparatus. Production rates can be kept very high, if desired, and maintenance problems can be avoided.

The method according to the invention provides for supporting a plurality of workpieces for movement along a predetermined path of travel. Abrasive particles are projected onto the workpieces as the workpieces are advanced along the path of travel. The workpieces are advanced along the path of travel by oscillating the workpiece support in a single plane. In one embodiment of the invention, the workpiece support is rotated as the workpieces are advanced along the path of travel. In another embodiment, the workpiece support is oscillated about an axis parallel with the path of travel as the workpieces are advanced along the path of travel.

Apparatus for carrying out the method according to the invention includes a generally horizontally oriented barrel, the barrel having skeletal walls defining openings along its length. The barrel is open at both ends to define a feed end and an exit end, the openings at the ends of the barrel permitting workpieces to enter and exit the barrel. The barrel is rotated about its longitudinal axis while workpieces are being advanced through the barrel. The walls of the barrel are constructed and arranged such that a variety of differently sized workpieces can be passed through the barrel; in one embodiment, the workpieces are sufficiently small relative to the barrel that the workpieces can be tumbled together during their passage through the barrel.

A plurality of abrasive particle throwing devices such as centrifugal throwing wheels are disposed adjacent the barrel in order to project abrasive particles through the openings in the walls at high speeds onto workpieces passing through the barrel. By appropriate selection of such variables as the type of abrasive particles, the speed of propulsion of the particles, the orientation of blast streams of abrasive particles relative to the barrel, and so forth, the workpieces can be cleaned exceedingly effectively.

The workpieces are advanced through the barrel without pushing the workpieces end-to-end or without employing a workpiece-engaging means. The means for advancing the workpieces engages the barrel and oscillates it axially such that individual workpieces disposed in the barrel are moved from the feed end of the barrel toward the exit end. This is accomplished by providing a tube that is included as part of the barrel near the exit end of the barrel. The tube includes a side opening through which workpieces can be discharged from the barrel. An oscillating actuator is connected to the tube for oscillating the tube in a direction parallel to the longitudinal axis of the barrel. A relatively movable connection is provided between the tube and the actuator such that the tube can be rotated while the actuator remains stationary.

A means for rotating the barrel is provided as part of the invention. The means for rotating the barrel includes a ring circumferentially disposed about the barrel and secured to the barrel such that rotation of the ring causes the barrel to rotate. A selectively rotatable drive wheel or gear is disposed in engagement with the ring. A connection is provided as part of the means for rotating the barrel such that the barrel can be rotated while axial movement of the barrel occurs. The connection is provided by longitudinally extending tracks included as part of the ring and rollers included as part of the barrel, the tracks and rollers being disposed in engagement with each other. Additionally, a thrust bearing is provided in engagement with the ring, the thrust bearing permitting rotational movement of the ring while preventing axial movement of the ring.

Apparatus for carrying out the method according to the invention also includes a differently configured barrel especially adapted to be operated as a barrel tumbler. In this embodiment, the barrel is generally horizontally oriented and includes a trough-like center section. The barrel is open at both ends to define a feed end and an exit end, the openings at the ends of the barrel permitting workpieces to enter and exit the barrel. The barrel is oscillated about its longitudinal axis while workpieces are being advanced through the barrel. The barrel includes bottom walls which intersect at a large angle to create a shallow bed depth. A stopping mechanism is provided so that the barrel can be oscillated at a high rate of speed throughout its arc and then decelerated rapidly. The barrel also can be oscillated through a smaller arc, if desired. A shield is disposed about the barrel in order to prevent workpieces from falling out of the barrel as the barrel approaches or attains its extreme oscillation positions.

With either embodiment, workpieces can be advanced through the barrel with whatever spacing is desired. Problems associated with end cleaning are eliminated. Because it no longer is necessary to provide workpiece-engaging mechanisms to advance the workpieces, production capability is very flexible and can be maintained on the order of 800–1200 parts per hour, if desired. Additionally, the elimination of workpiece-engaging devices eliminates maintenance problems as well as manufacturing expense. Moreover, the vibratory nature of the workpiece-advancing mechanism tends to eliminate the jamming of workpieces which, in turn, means that the barrel has a greater tolerance for processing differently sized workpieces. The foregoing and other features and advantages of the present invention will become more apparent by reference to the following description and the accompanying drawings.

Figure 13:
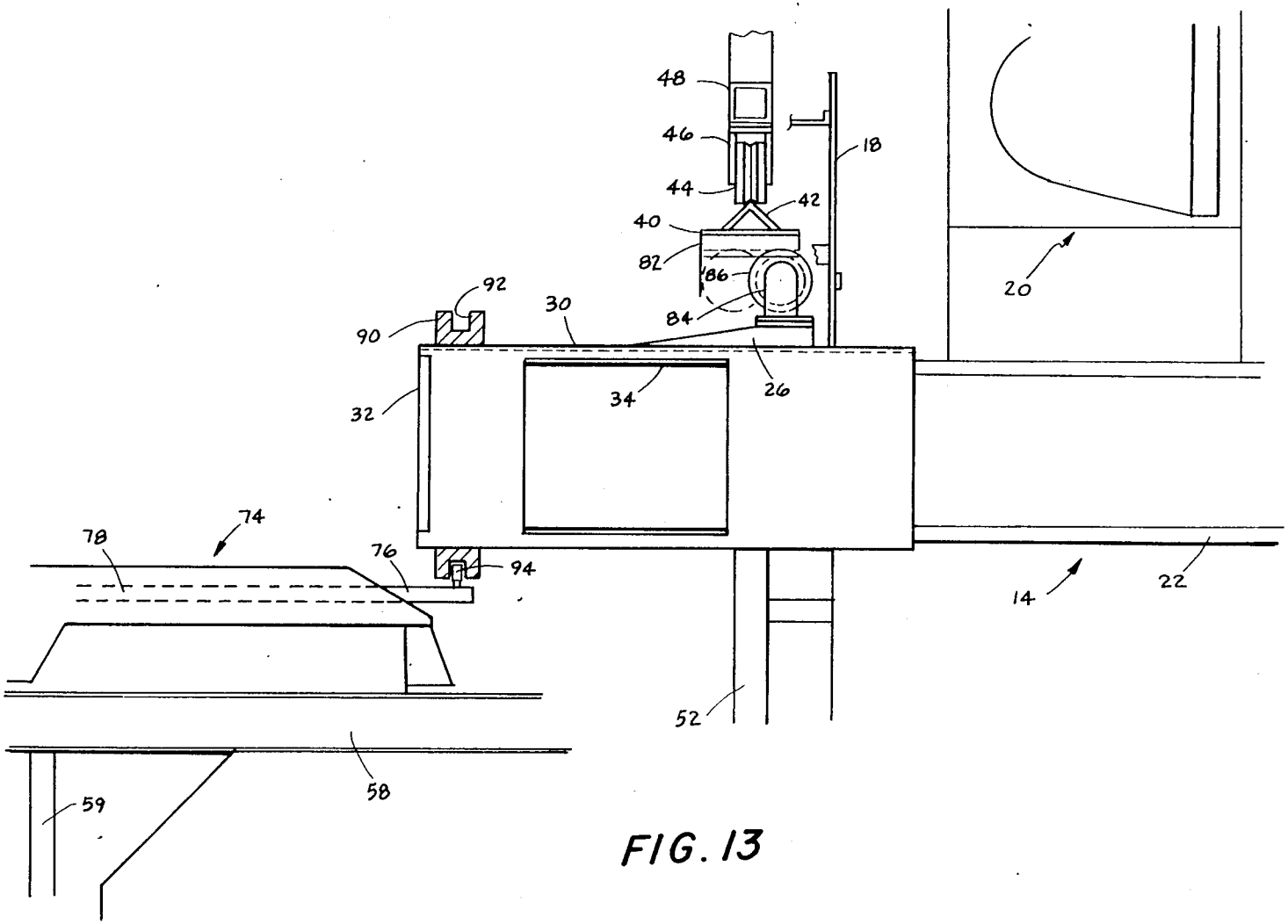
Figure 14:
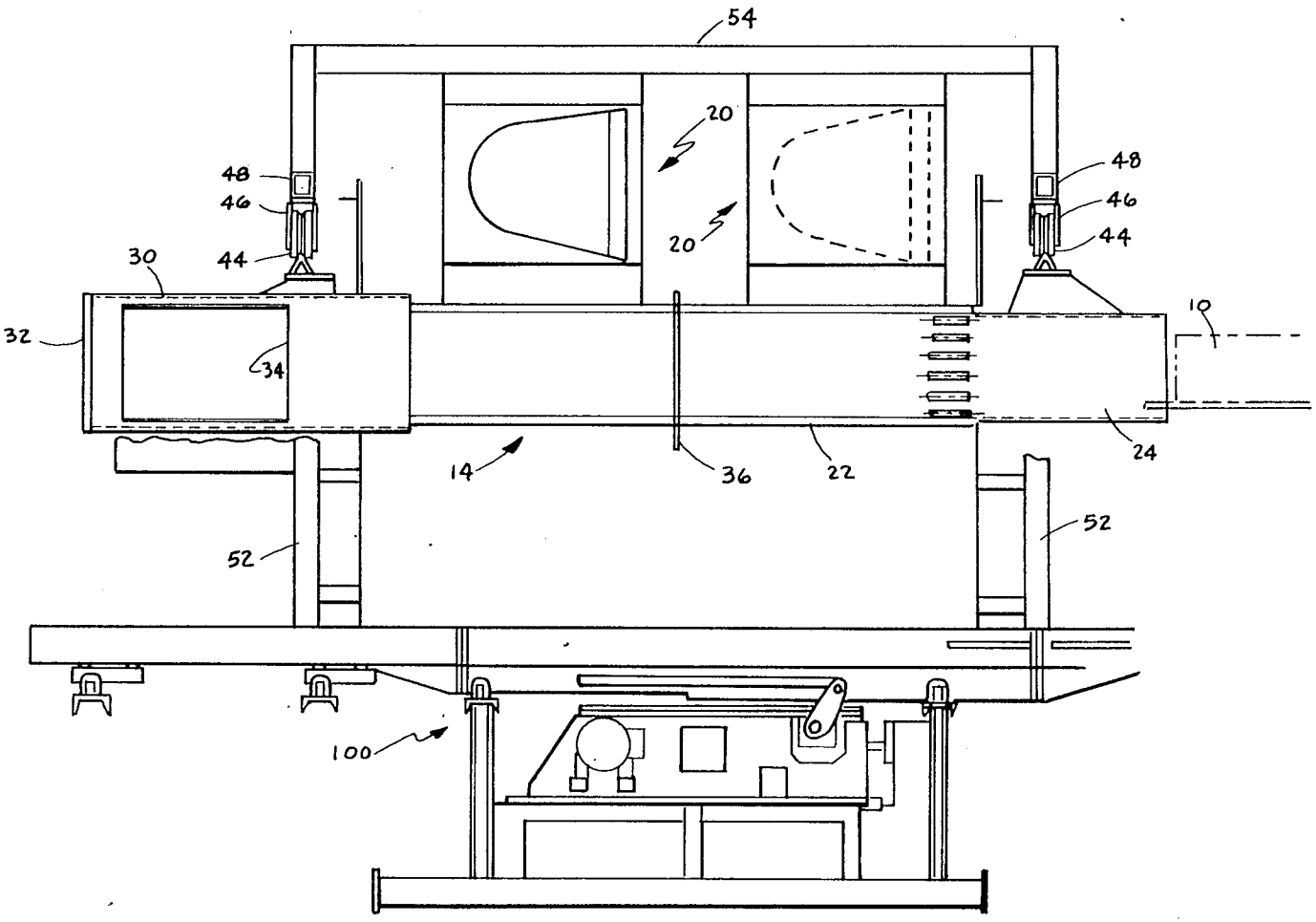
Figure 15:
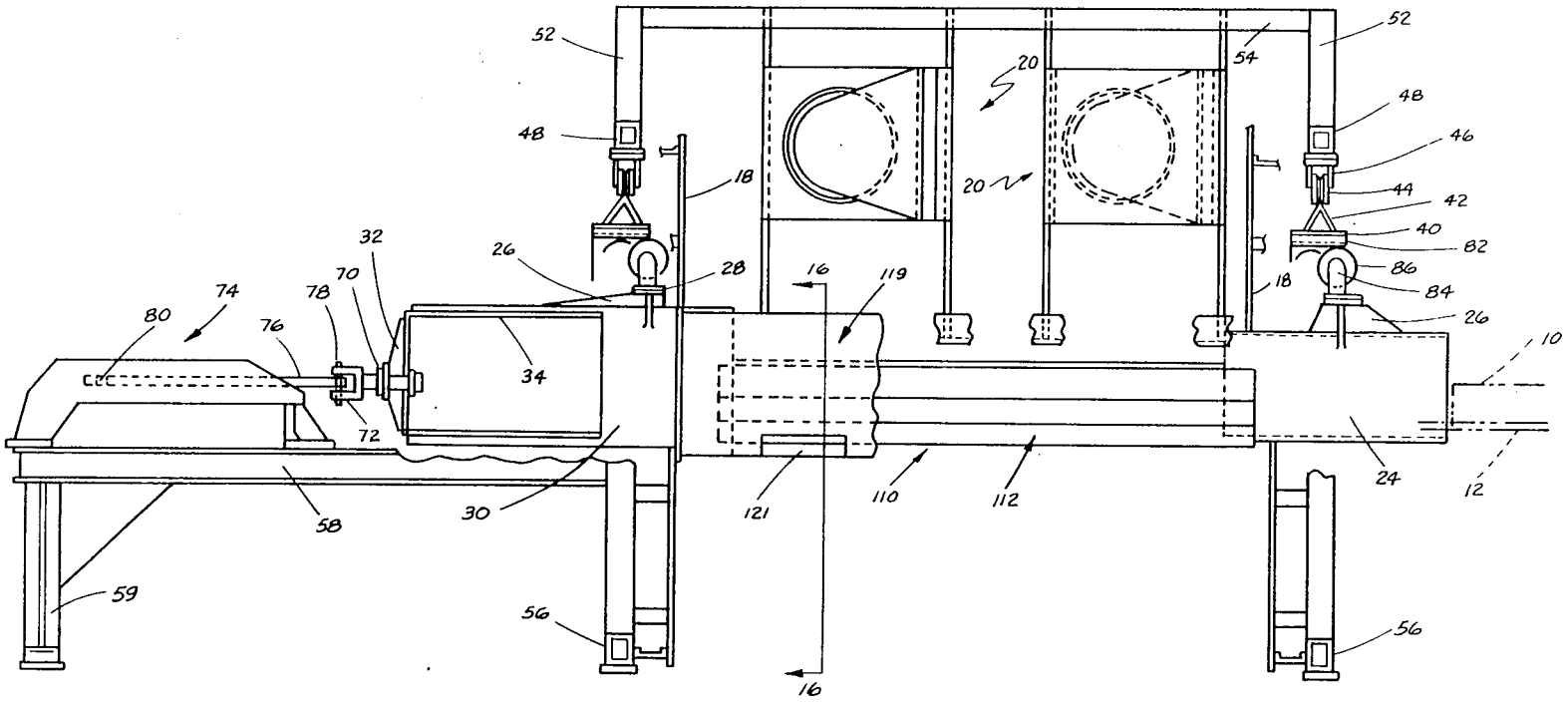
Figure 16:
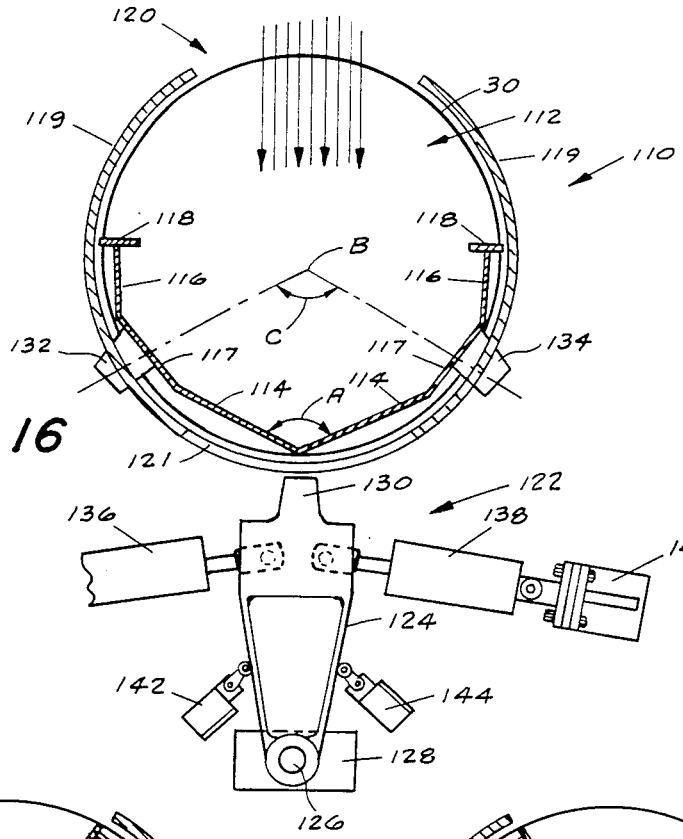
Figure 17:
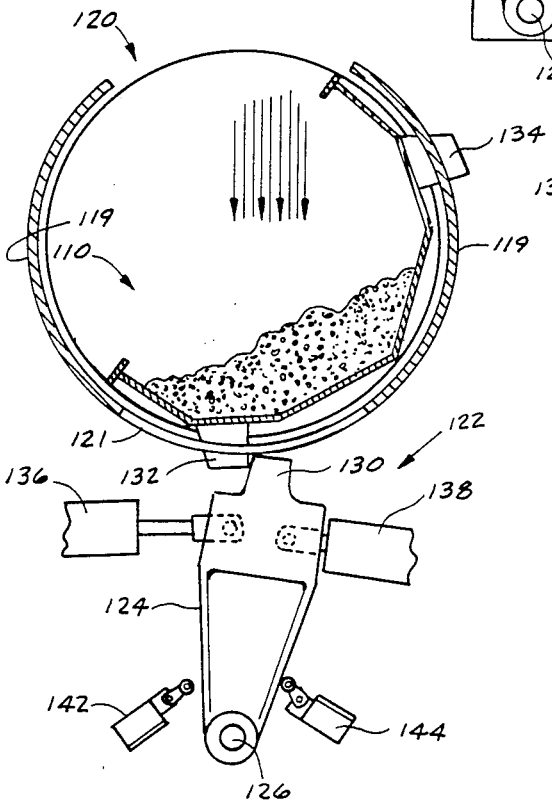
Figure 18:
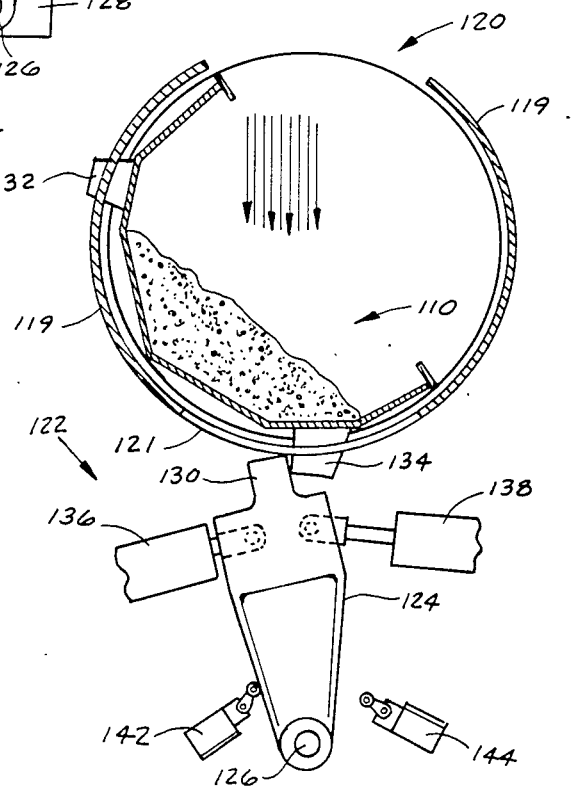

FIG. is a schematic representation of small workpieces disposed within a barrel according to the invention;

FIG. 13 is a side elevational view of an alternative embodiment of a workpiece-advancing mechanism;

FIG. 14 a side elevational view of another alternative embodiment of a workpiece-advancing mechanism;

FIG. 15 is a side elevational view of an alternate embodiment of a barrel according to the invention;

FIG. 16 is a view taken along a plane indicated by line 16—16 in FIG. 15; and FIGS. 17 and 18 are views of the barrel of FIG. 15 in extreme counterclockwise and clockwise positions.

DESCRIPTION OF THE PREFERRED EMBODIMENT

Referring to FIGS. 1–4, an apparatus for cleaning large batches of continuously fed parts such as automobile engine heads, manifolds, blocks, and the like is shown. For convenience, all such parts will be referred to hereafter as workpieces and will be identified by the reference numeral 10. The workpieces 10 are fed by automatic feed means such as a walking beam load conveyor 12 to the open feed end of a rotatable barrel 14. The barrel 14 is of skeletal wall construction. The workpieces 10 are pushed into the end of the barrel 14 by a pneumatically actuated piston 16. The barrel 14 is horizontally oriented and is rotatable about its longitudinal axis. The workpieces 10 advance from the feed end of the barrel 14 toward the exit end of the barrel 14 while the barrel 14 is rotated, either continuously or in start-and-stop intervals. Cleaned workpieces 10 received from the exit end of the barrel 14 are discharged onto an oscillating unload conveyor 17 for removal from the cleaning area.

Figure 7:
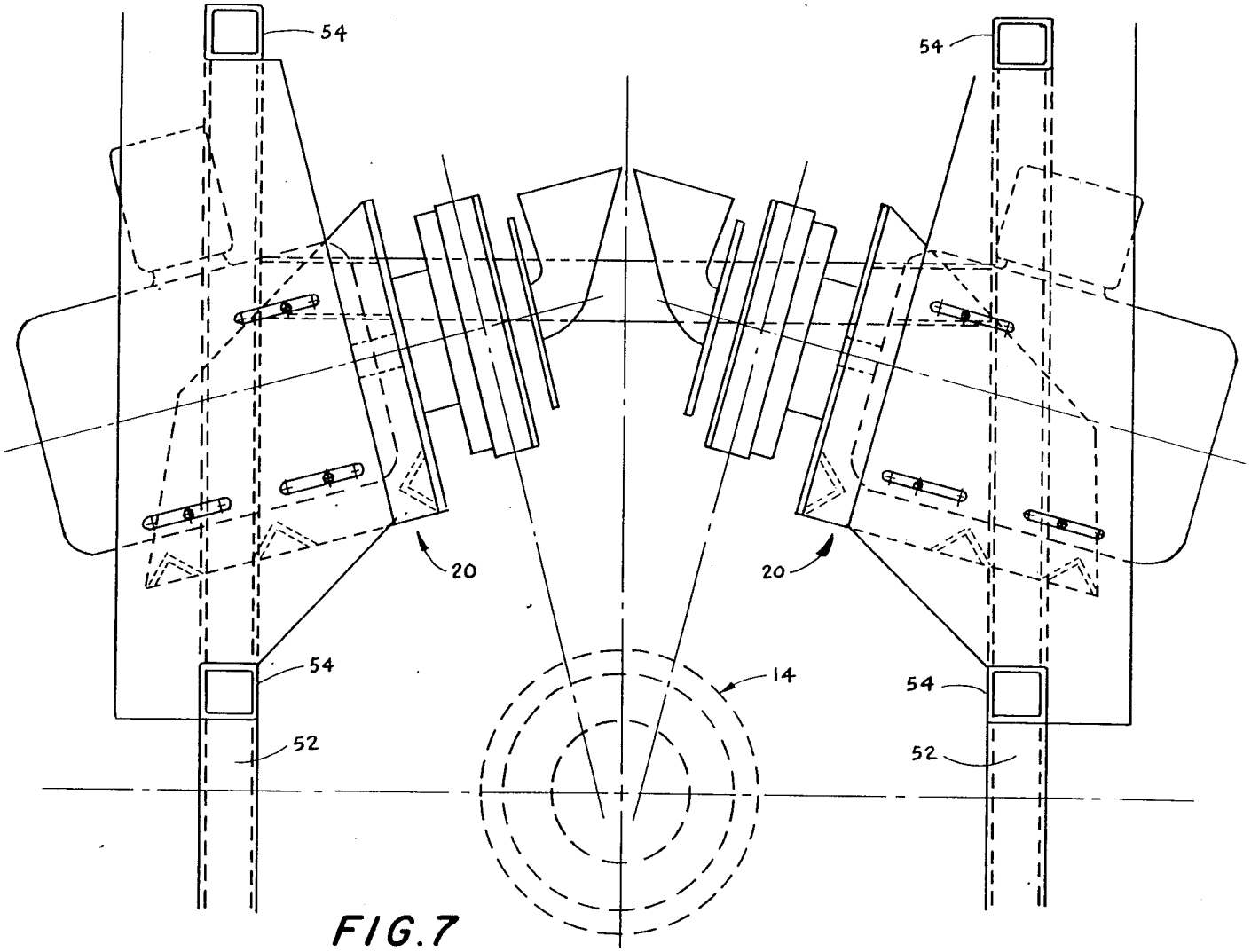
FIGS. 7 and 8 are views taken along planes indicated by lines 7—7 and 8—8 in FIG. 4.

The barrel 14 is disposed within a cleaning cabinet 18. A plurality of abrasive particle throwing means in the form of blast wheels 20 are disposed in the cleaning cabinet 18. The blast wheels 20 are commercially available units manufactured by Pangborn of Hagerstown, Md. As will be apparent from an examination of FIGS. 1, 4 and 7, the blast wheels 20 are located in positions such that workpieces 10 passing through the barrel 14 will be impinged with abrasive particles. Because the workpieces 10 are being rotated during their passage through the barrel 14, all surfaces of the workpieces 10 will be impacted by abrasive particles. More details concerning the general construction and operation of the cleaning apparatus described thus far can be obtained by referring to the previously referenced patents, particularly the Axi-Flow Patent.

Referring particularly to FIGS. 4–6 and 8–10, the barrel 14 and its supporting mechanism are shown in more detail. The barrel 14 includes a plurality of spaced guide bars 22 which create the skeletal wall construction of the barrel 14. The feed end of the barrel 14 is defined by a cylindrical load tube 24 disposed adjacent the conveyor 12 and the piston 16. The guide bars 22 are welded about the outer diameter of the load tube 22; this construction ensures that workpieces 10 will be unimpeded during their progress through the feed end of the barrel 14. A plurality of gussets 26 are welded to the outer surface of the load tube 24 in order to provide support for mounting pads 28.

A cylindrical unload tube 30 is disposed at the exit end of the barrel 14. The guide bars 22 are welded to the inner diameter of the unload tube 30; this construction provides that workpieces 10 will not be impeded during their progress into the exit end of the barrel 14. The tube 30 also includes an end closure 32 and an opening 34 in its side. Like the load tube 24, the unload tube 30 includes a plurality of gussets 26 to provide support for mounting pads 28. A hoop 36 is disposed about the guide bars 22 near the mid point of the barrel 14 in order to provide support for the guide bars 22.

The barrel 14 includes rings 40 circumferentially disposed about the barrel 14 at both the feed end and the exit end. The rings 40 are in engagement with the barrel 14 such that rotation of the rings 40 causes the barrel 14 to rotate. Each of the rings 40 includes a radially extending, circumferential flange 42. The flanges 42 ride upon grooved rollers 44. The axis of rotation of the rollers 44 is parallel to the longitudinal axis of the barrel 14. The rollers 44 are rotatably attached to casters 46. The flanges 42 and the rollers 44 constitute thrust bearings to prevent axial movement of the rings 40.

The uppermost casters 46 are secured to horizontal frame members 48. The lower casters 46 are secured to inclined braces 50. The braces 50 and the horizontal frame members 48 are connected at each end of the apparatus by uprights 52. The uprights 52 are connected to each other by longitudinally extending beams 54 and lower, laterally extending beams 56. A horizontally disposed rectangular frame 58 is connected to the uprights 52 at the left of the apparatus as viewed in FIG. 1. The frame 58 is supported by vertical posts 59.

Figure 8:
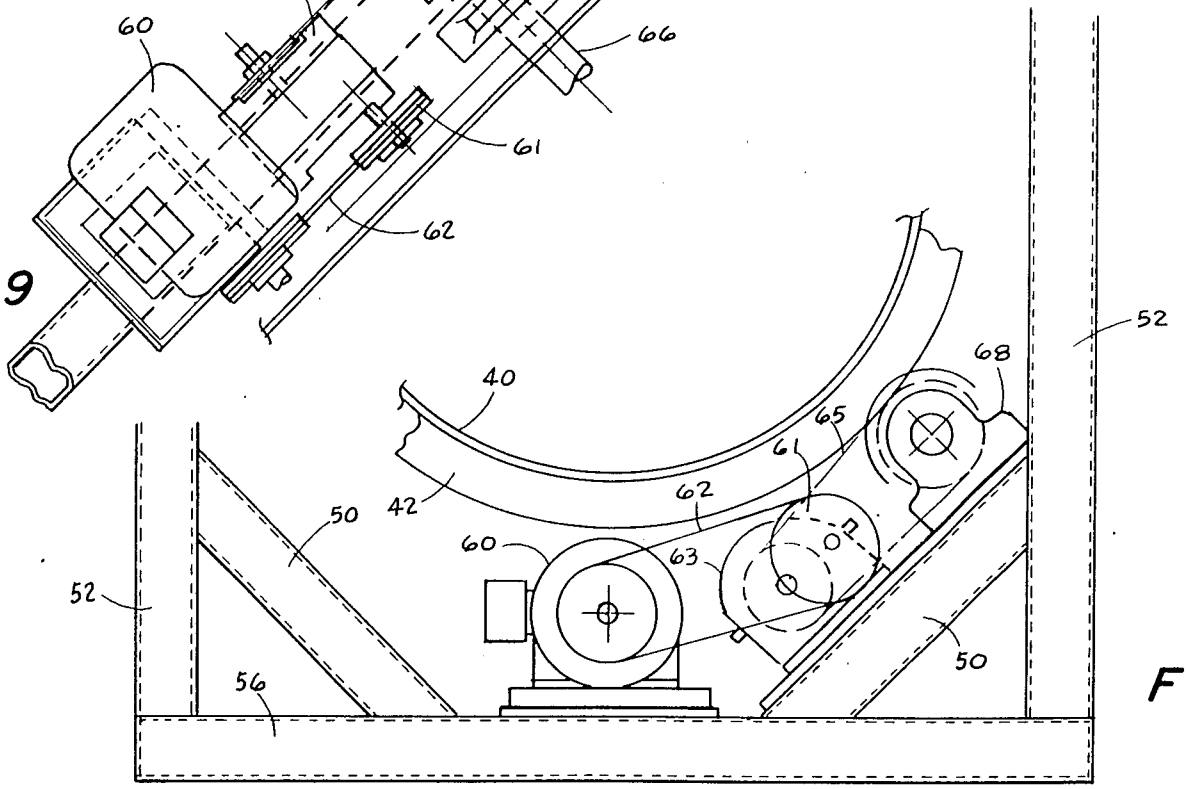
Figure 9:
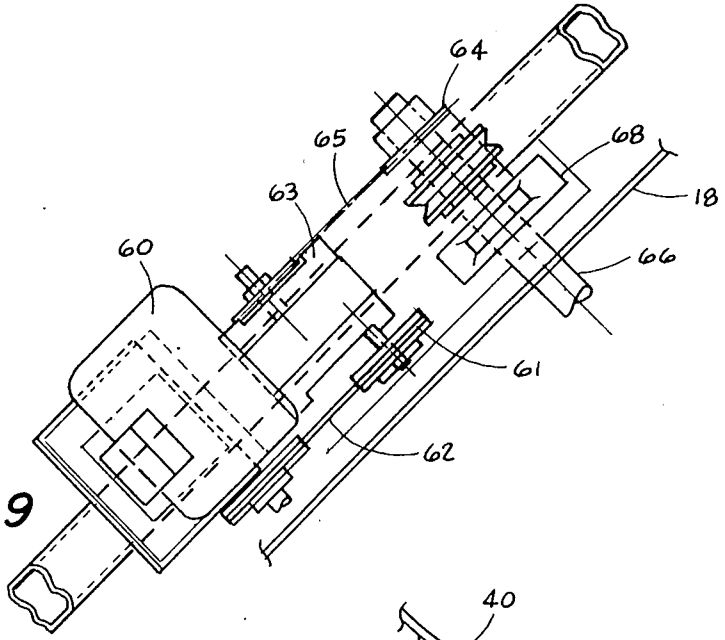
FIG. 9 is a top plan view of the apparatus shown in FIG. 8.
Figure 10:
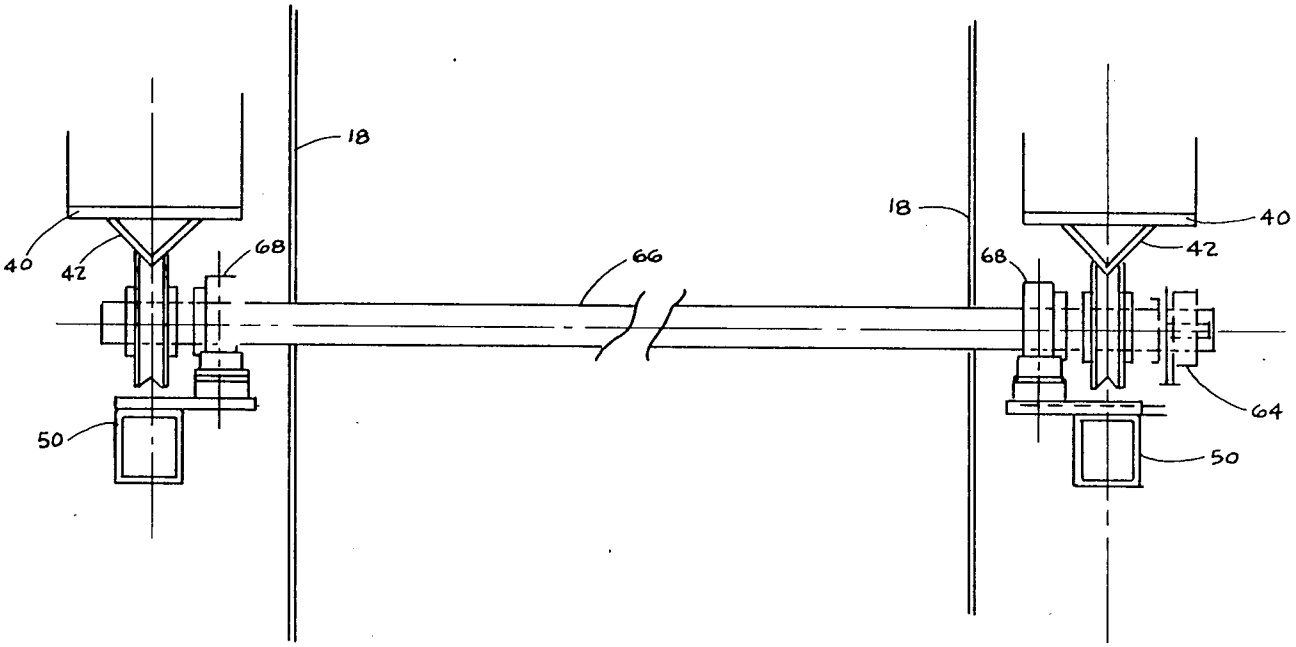
FIG. 10 is a view taken along a plane indicated by line 10—10 in FIG. 5.

The cleaning apparatus includes means for rotating the barrel 14. Referring particularly to FIGS. 8, 9 and 10, the means for rotating the barrel 14 includes a drive motor 60 secured to one of the beams 56 at one end of the apparatus. The drive motor 60 drives a sheave 61 by means of a belt 62. The sheave 61 drives a speed reducer 63 which in turn drives a sprocket 64 by means of a chain 65. The motor 60 is a 5 horsepower motor rated at 1800 r.p.m. The speed reducer 63 is a Winsmith Model 800 having a 4.3:1 reduction ratio. The sprocket 64 is secured to a longitudinally extending shaft 66 having an axis of rotation disposed parallel to the longitudinal axis of the barrel 14. The shaft 66 is supported at each end by pillow blocks 68 secured to the braces 50. One of the rollers 44 is secured to the shaft 66 near each end of the shaft. Because the rollers 44 are in engagement with the flanges 42, upon activation of the drive motor 60, the sprocket 64 will be driven by the chain 65 and the shaft-mounted rollers 44 will rotate the barrel 14 about the longitudinal axis of the barrel 14. The motor 60, the speed reducer 63, and the various sheaves, sprockets, and rollers cooperate to rotate the barrel 14 up to 45 r.p.m. in either direction, either continuously or in a back-and-forth, oscillating manner.

Figure 3:
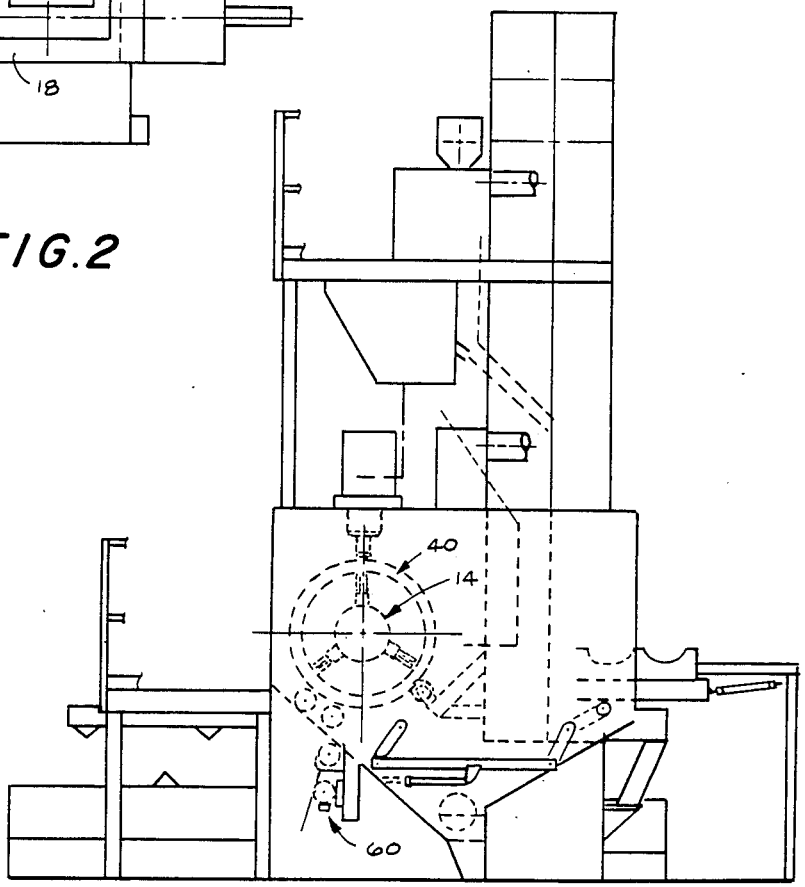
FIG. 3 is an end view of the appartus of FIG. 1.

If desired, a roller chain (not shown) can be disposed about the periphery of one of the rings 40 and a sprocket (not shown) can be positioned along side one of the rollers 44. The chain and sprocket will interact to provide a positive mechanical drive as is known to those skilled in the art. It will be appreciated that various techniques such as the foregoing and as shown in the Axi-Flo patent can be used to rotate a structure such as the barrel 14. Moreover, the components illustrated in FIGS. 8–10 can be arranged differently relative to the barrel 14. For instance, FIG. 3 shows an alternate arrangement in which the drive components are arranged vertically on the left side of the barrel 14 (instead of on the right side as shown in FIG. 8).

The cleaning apparatus also includes means for advancing workpieces 10 through the barrel 14. The means for advancing the workpieces is in the form of an oscillating mechanism including a bearing 70 secured to the center of the end closure 32. A clevis 72 is secured to the bearing 70. An oscillating actuator 74 is disposed near the exit end of the barrel 14 and is supported by the frame 58. The actuator 74 includes a puller rod 76 connected to the clevis 72 by means of a pin 78. The rod 76 is connected to an oscillating crank 80 which in turn is driven by a motor (not shown). The bearing 70, the clevis 72, and the pin 78 provide a relatively movable connection between the barrel 14 and the actuator 74 such that the barrel 14 can be rotated while the actuator 74 remains stationary. The actuator 74 can be any of several devices to provide oscillating motion in a single plane. For example, a flat stroke shaker conveyor drive unit, model Mark II, providing 77 strokes per minute, manufactured by the Goodman Equipment Corporation of Chicago, Ill., is acceptable as an actuator 74. The actuator 74 provides a flat, relatively high speed forward thrust (to the right as viewed in FIGS. 1 and 4) and a flat, relatively slow return stroke (to the left as viewed in FIGS. 1 and 4). Such a motion of the barrel 14 causes workpieces 10 to be advanced through the barrel 14 smoothly and steadily.

In order to control the rate of advance of workpieces 10 through the barrel 14, it is necessary to control the action of the actuator 74. This can be done by a number of techniques, as is known to those skilled in the art. For example, an air motor or hydraulic motor can be used to drive the crank 80. By operating the air motor or hydraulic motor at desired intervals, a selected rate of workpiece advance can be obtained. If an electric motor is used to power the crank 80, a clutch can be interposed between the electric motor and the crank 80. By appropriate actuation of the clutch, the electric motor can be run continuously, and yet a desired rate of workpiece advance can be obtained.

Figure 6:
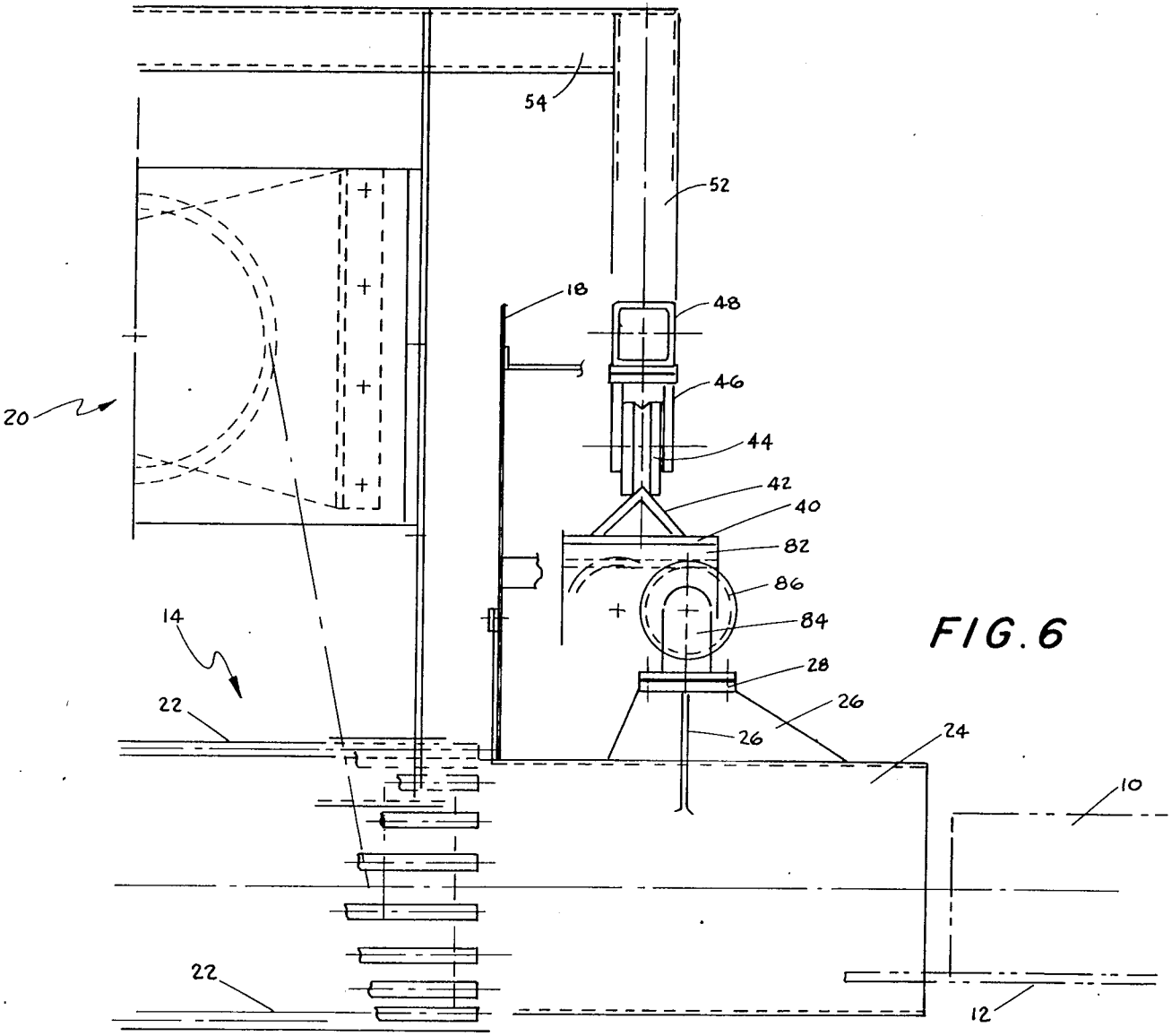
FIG. 6 is an enlargement of a portion of FIG. 4 showing a portion of a barrel and its supporting mechanism.

The cleaning apparatus also includes a connection which permits relative axial movement between the rings 40 and the barrel 14 while preventing relative rotational movement between the rings 40 and the barrel 14. The connection is provided by a plurality of longitudinally extending tracks 82 secured to the inner diameter of the rings 40. A plurality of casters 84 are secured to the mounting pads 28. The casters 84 rotatably support a plurality of grooved rollers 86. The axis of rotation of the rollers 86 is orthogonal to the longitudinal axis of the barrel 14. The rollers 86 are in engagement with the tracks 82. As can be seen from FIGS. 4 and 6, the axial extent of the tracks 82 is such as to permit a limited axial excursion of the barrel 14. The position of the barrel 14 illustrated in FIGS. 4 and 6 is the extreme right-hand position of the barrel 14; the extreme left-hand position of the barrel 14 is illustrated by the dotted line position of the rollers 86.

Figure 1:
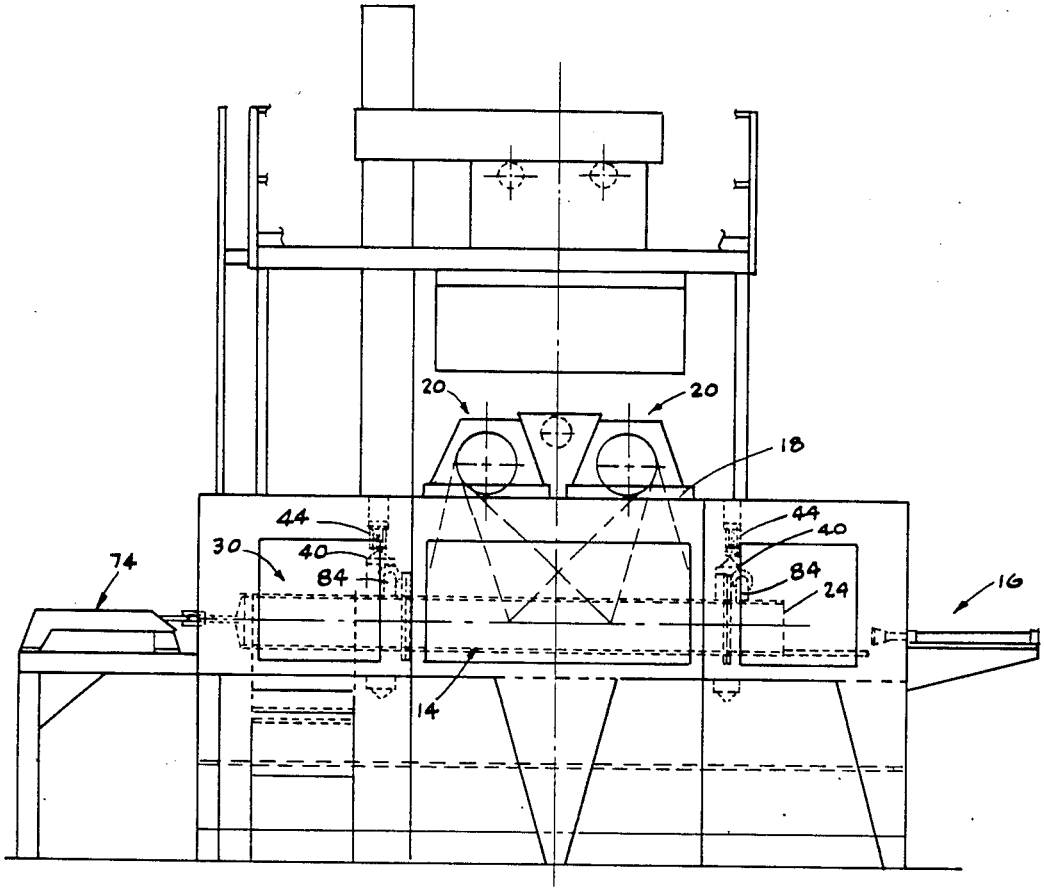
FIG. 1 is a side elevational view of a workpiece cleaning apparatus according to the invention.
Figure 2:
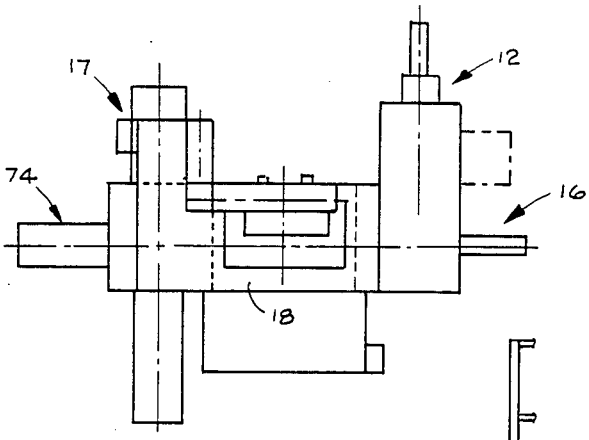
FIG. 2 is a top plan view of the apparatus of FIG. 1.
Figure 4:
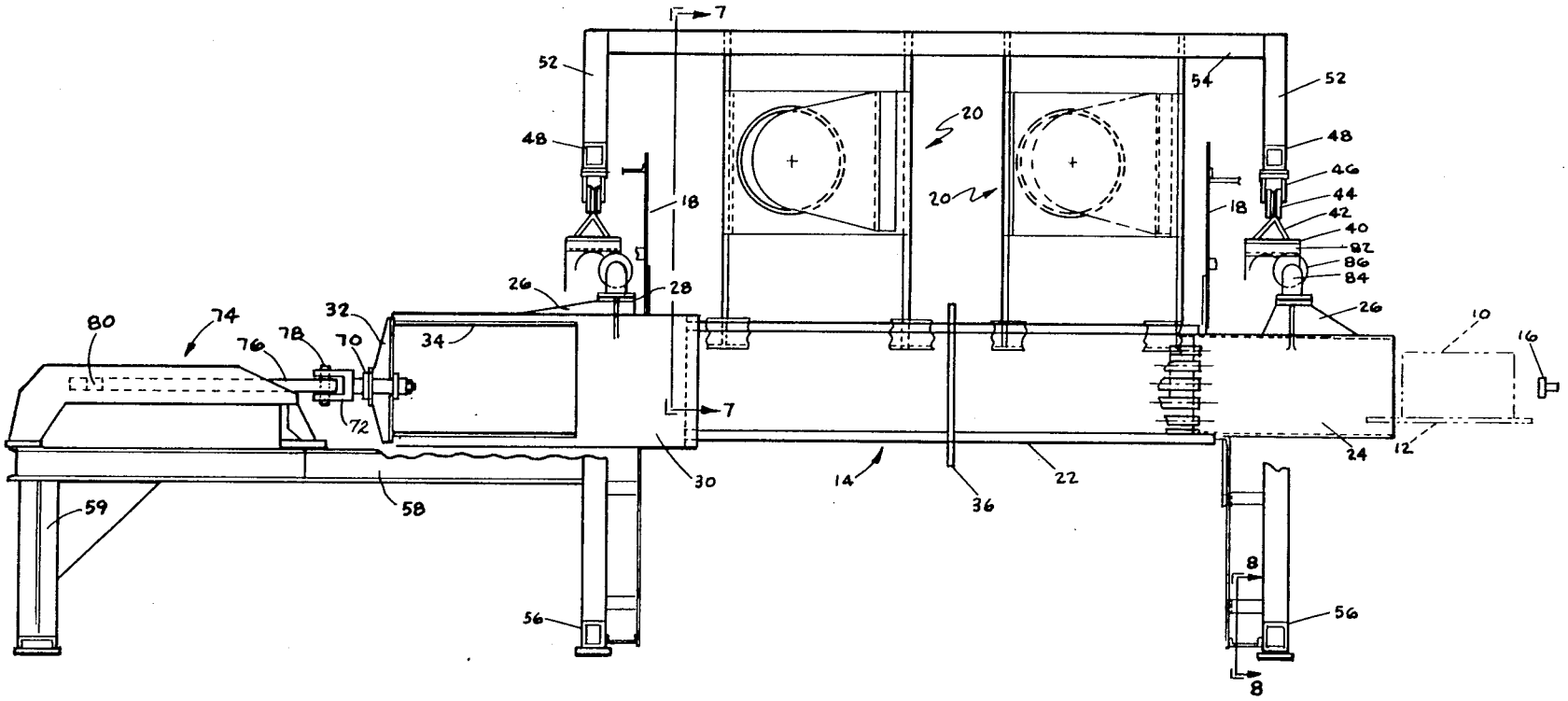
FIG. 4 is an enlarged side elevational view of a barrel shown in FIG. 1.
Figure 5:
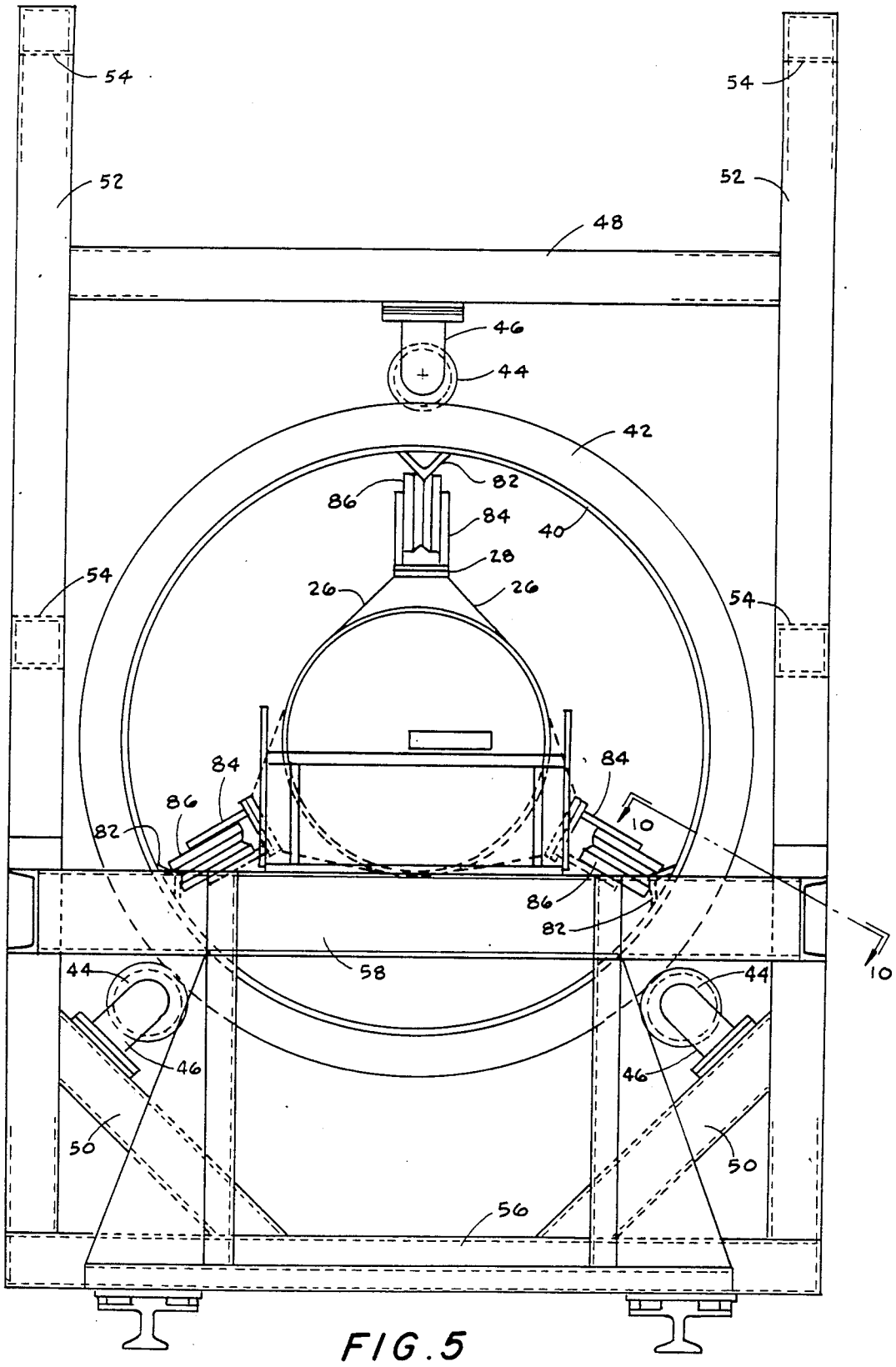
FIG. 5 is an enlarged end view of a portion of the apparatus shown in FIG. 1.

It will be appreciated that the actuator 74 can be operated such that workpieces 10 can be advanced through the barrel 14 in a reverse direction, that is, from left to right as viewed in FIGS. 1 and 4. In effect, the unload tube 30 would become a load tube, and the load tube 24 would become an unload tube. In that circumstance, the rotation of the barrel 14 would have to be coordinated with the loading of workpieces 10 into the tube 30 through the opening 34. Also, the guide bars 22 should be secured to the outer diameter of the tube 30 and to the inner diameter of the tube 24 so as to avoid impeding progress of workpieces 10 through the barrel 14. Such an arrangement would have the advantage of placing the barrel 14 in compression on the high speed stroke of the actuator 74. A disadvantage of such an arrangement is that loading of the workpieces 10 into the barrel 14 has to be coordinated with rotation of the tube 30. In the first-described embodiment, workpieces 10 can be loaded into the tube 24 at any rotational position of the barrel 14. Workpieces 10 can be discharged from the unload tube 30 whenever the opening 34 faces downwardly enough for the workpieces 10 to fall out of the opening 34.

Figure 11:
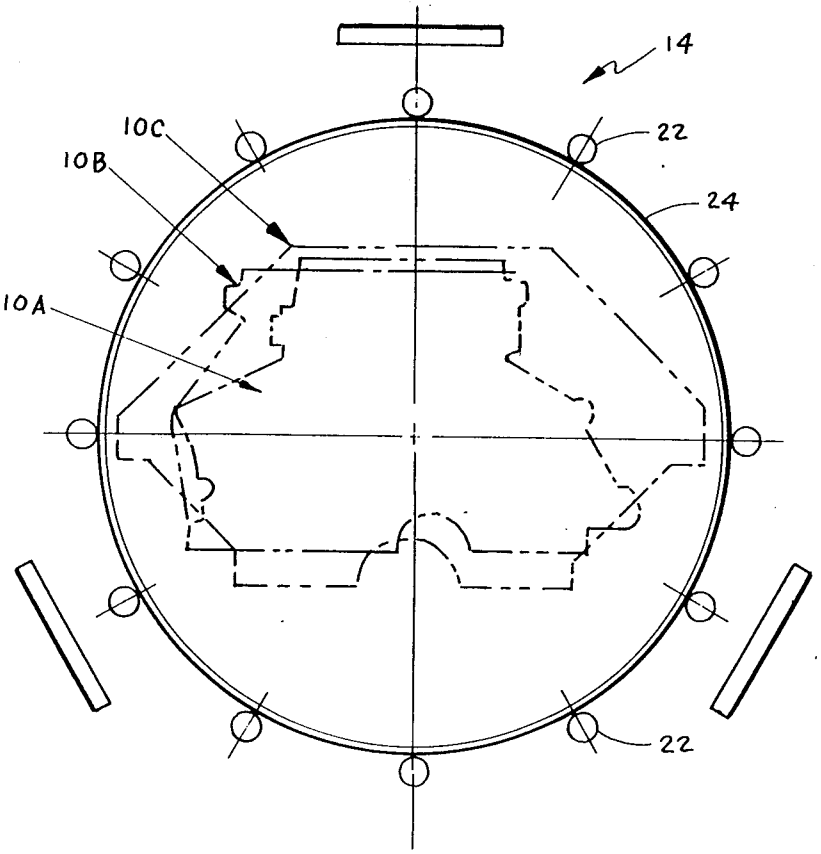
FIG. 11 is a schematic representation of differently sized workpieces disposed within a barrel according to the invention.

Referring particularly to FIG. 11, three differently sized pieces 10A, 10B and 10C are shown as being disposed within the barrel 14. The workpieces 10A and 10B are relatively small automobile engine blocks, while the workpiece 10C is a relatively large, V-8 automobile engine block. In the case of each of the workpieces 10A, 10B, 10C, the workpieces are loosely disposed within the barrel 14. During their travel through the barrel 14, the workpieces 10A, 10B, 10C will be tumbled about vigorously. Due to the oscillating nature of the barrel 14 and due to the spacing of the workpieces 10 (which can be controlled by appropriate actuation of the piston 16), the workpieces 10A, 10B, 10C will not jam within the barrel 14, either by skewing or by attempting to move past each other. Because the barrel 14 does not have to closely conform to the configuration of the workpieces 10A, 10B, 10C, not only can a variety of differently sized workpieces be processed, but the differently sized workpieces can be intermingled as may be desired.

Figure 12:
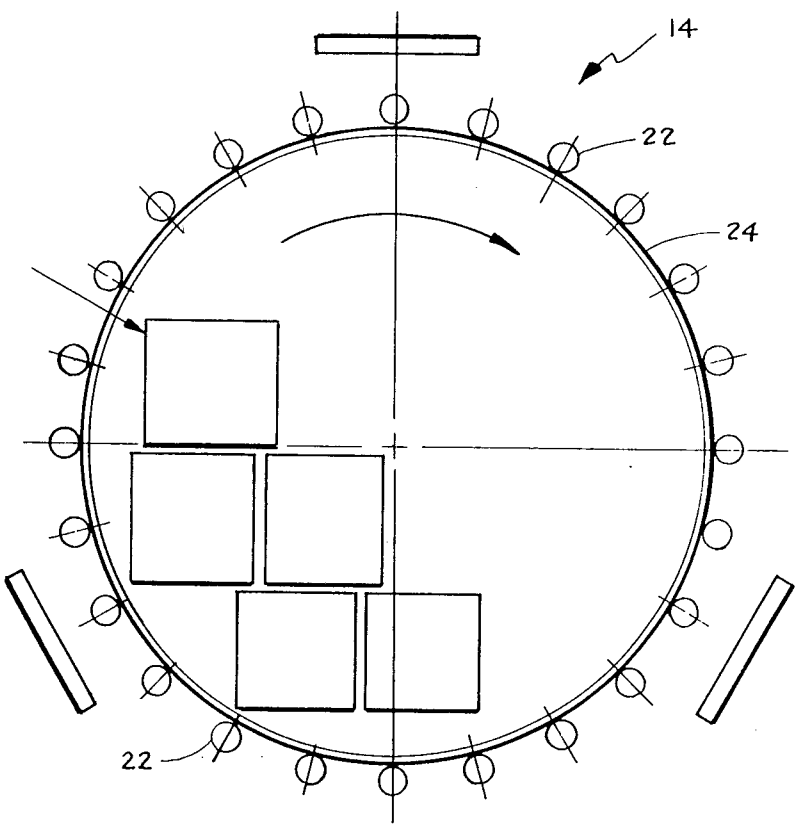

Referring now to FIG. 12, the barrel 14 is shown as having a greater number of guide bars 22 and smaller workpieces 10D. The workpieces 10D are loosely fitted within the barrel 14. In effect, the barrel configuration illustrated in FIG. 12 provides a barrel tumbler. The workpieces 10D not only are cleaned by abrasive particles thrown through the openings in the guide bars 22, but they also are cleaned by interacting with themselves and abrasive particles as they are tumbled about during their passage through the barrel 14. Although the barrel configuration illustrated in FIG. 12 has the potential drawback of needing more horsepower to throw abrasive particles through the smaller openings between the guide bars 22, the flexibility of being able to clean a great quantity of small workpieces can be an advantage under certain circumstances.

Referring now to FIG. 13, an alternative embodiment of the workpiece advance mechanism is illustrated. In this embodiment, the unload tube 30 is provided with a ring 90 secured near its end. The ring 90 includes a circumferential groove 92. The actuator 74 is connected to the ring 90 by means of a roller 94 fitted within the groove 92. The roller 94 provides a relatively movable connection between the ring 90 and the actuator 74 such that the barrel 14 can be rotated while the actuator 74 remains stationary. One of the advantages of such an arrangement is that the overall length of the apparatus can be shorter because the actuator 74 is not disposed in line with the longitudinal axis of the barrel 14.

Referring now to FIG. 14, yet an additional alternative embodiment of the workpiece advancing mechanism is shown schematically. In the embodiment shown in FIG. 14, the complete cleaning apparatus, including the supporting framework, is mounted atop an oscillating conveyor 100 such that the entire barrel 14 and its rotating mechanism are oscillated. An acceptable conveyor 100 is commercially available from the Goodman Equipment Corporation of Chicago, Ill., Model H-20, providing 70 strokes per minute. In this alternative embodiment, because the entire cleaning apparatus is oscillated, there is no need to provide the tracks 82, the casters 84 and the rollers 86. Rather, the barrel 14 can be secured directly to the rings 40 by way of the rollers 44 and the casters 46. This arrangement of elements has the advantage of eliminating any difficulties associated with crowding either the feed end or the exit end of the barrel 14 with the actuator 74, but suffers the disadvantage of oscillating a large weight.

Referring to FIGS. 15–18, another embodiment of the invention is illustrated. In this embodiment, a barrel 110 is substituted for the barrel 14. The barrel 110, like the barrel 14, is oriented generally horizontally. The barrel 110 includes a trough-like center section 112 defined by bottom walls 114, sidewalls 116, intermediate walls 117, and upper rails 118. A shield 119 is disposed closely about the center section 112 and is fastened at its ends to the cleaning cabinet 18. The shield 119 includes an opening 120 along its top and openings 121 along its bottom. If desired, the shield can be made in two separate sections defining top and bottom openings therebetween. The walls 114 are spaced from each other by an angle A which in the embodiment illustrated is approximately 130 degrees. The walls 116 are approximately vertical when the barrel 110 is in a neutral position as shown in FIG. 16. The barrel 110 is adapted to be oscillated, or rocked, about a longitudinal axis of the barrel indicated by the letter B in FIG. 16. Like the barrel 14, the barrel 110 includes a load tube 24 at its feed and an unload tube 30 at its exit end. Other components of the first-described embodiment such as the gussets 26, mounting pads 28, rings 40 and so forth are retained.

A stopping mechanism 122 is provided for the barrel 110. The stopping mechanism 122 includes a generally vertically oriented post 124 disposed beneath the axis B. The post 124 is pivotally mounted to one of the beams 56 by means of a pintle 126 secured to a plate 128. The upper end of the post 124 includes an upwardly projecting portion 130. Bosses 132, 134 extend outwardly of the tube 30 in axial alignment with the projecting portion 130. The bosses 132, 134 are spaced from each other by an angle C which in the embodiment illustrated is approximately 120 degrees. The stopping mechanism also includes hydraulic shock absorbers 136, 138 pivotally secured at one end to the post 124 and pivotally secured at the other end to pads 140. The pads 140 are secured to the uprights 52. A pair of limit switches 142, 144 are secured to the braces 50 such that roller arms 146 of the limit switches 142, 144 are in contact with the post 124. The limit switches 142, 144 are connected to the motor 60 and control the motor's direction of rotation.

As can be seen from an examination of FIG. 17, upon oscillating the barrel 110 to an extreme counterclockwise position, the boss 132 will hit the projecting portion 130, whereupon the shock absorber 136 will be extended, the shock absorber 138 will be compressed, and the limit switch 144 will be actuated. The shock absorber 138 causes the barrel 110 to decelerate rapidly to a complete stop. The limit switch 144 is connected to the motor 60 such that the motor 60 reverses direction upon actuation of the limit switch 144.

Referring now to FIG. 18, upon oscillating the barrel 110 to an extreme clockwise position, the boss 134 will hit the projecting portion 130, whereupon the shock absorber 136 will be compressed, the shock absorber 138 will be extended, and the limit switch 142 will be actuated. The shock absorber 136, will cause the barrel 110 to decelerate rapidly to a complete stop. The limit switch 142 is connected to the motor 60 such that the motor 60 reverses direction upon actuation of the limit switch 142.

The barrel 110 also can be oscillated in a programmed manner to less than its extreme clockwise and counterclockwise positions. For example, the limit switches 142, 144 or other limit switches (not shown) can cause the barrel 110 to oscillate to an extreme clockwise position, then to a position about 60 degrees short of an extreme counterclockwise position, then to a position about 60 degrees short of the extreme clockwise position, and then to the extreme counterclockwise position, whereupon the cycle can be repeated. Other oscillation schedules can be employed, if desired, to attain different cleaning results as may be appropriate for different workpieces.

It will be appreciated that various techniques can be used to oscillate the barrel 110, including the motor 60 and related components described previously. It is possible to employ an air motor (not shown) in place of the motor 60 or as the motive force for the chain and sprocket construction referred to earlier. If an air motor is used, it is possible to stall the air motor upon attaining the extreme clockwise and counterclockwise barrel positions, whereupon the direction of the air motor can be reversed. A particularly powerful technique for oscillating the barrel 110 is to employ a hydraulic rotary actuator (not shown) such as that disclosed in the Axi-Flow patent.

From the foregoing desription, it will be apparent that the invention provides an effective technique for cleaning workpieces, including the ends of the workpieces. By appropriate control of the conveyor 12 and the piston 16, workpieces 10 can be inserted into the barrel 14 at intervals such that a predetermined spacing between adjacent workpieces 10 will be maintained as the workpieces 10 advance through the barrel 14. Accordingly, the ends of the workpieces can be cleaned efficiently. Because the workpiece engaging the advancing mechanisms of the Uni-Bar and Trans-Bar machines have been eliminated, the reliability problems associated with those mechanisms likewise have been eliminated. Additionally, a high rate of production can be maintained. Also, due to the vibratory nature of the workpiece advancing mechanism, there is a reduced likelihood that workpieces 10 will be jammed within the barrel 14. In turn, a wider range of workpiece sizes can be accommodated by the barrel 14 without the need to adjust the spacing of the bars 22 or without the need to provide a barrel 14 of an entirely different size.

In those cases where the barrel 110 is employed, due to the existence of the stopping mechanism 122, the barrel 110 can be oscillated to a complete stop in very short intervals. Rapid oscillation can be accomplished while maintaining a single line of workpieces travelling through the barrel with a desired spacing among workpieces or while operating the barrel 110 as a barrel tumbler. During their travel through the barrel 110, the workpieces will be lifted as the barrel 110 approaches its extreme clockwise or counterclockwise position, and the workpieces then will fall toward the other side of the barrel 110, rotating as they fall. Even if workpieces should be thrown from the barrel 110 over the rails 118 as the barrel 110 approaches or attains its extreme clockwise or counterclockwise positions, the shield 119 will catch the displaced workpieces and cause them to fall back into the barrel 110 during the return oscillation. The openings 121 permit spilled abrasive particles or debris to be drained from the shield 119 for recycling or disposal. The oscillating motion imparted by the advancing mechanism enables the rate of travel of the workpieces to be varied as may be desired. When the barrel 110 is operated as a barrel tumbler, the shallow bed depth of the barrel 110 increases the cleaning rate since few or none of the workpieces will be buried under other workpieces and thus shielded from the blast. Additionally, because the blast is directed onto the workpieces without impacting any intervening portions of the barrel 110 or the shield 119, the cleaning action is very effective.

Although the invention has been described in its preferred form with a certain degree of particularity, it will be understood that the present disclosure of the preferred embodiment has been made only by way of example and that numerous changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. Apparatus for cleaning workpieces by the impingement of abrasive particles, comprising:

a generally horizontally oriented barrel having first and second ends, the barrel having at least one opening along its length, the barrel open at both ends to define a feed end and an exit end, the openings at the ends of the barrel permitting workpieces to enter and exit the barrel, the opening along the length of the barrel permitting abrasive particles to be projected into the barrel;

a stationary support frame for holding the barrel;

means for rotating the barrel about a longitudinal axis of the barrel, the means for rotating the barrel being carried by the support frame;

abrasive particle throwing means disposed adjacent the barrel for projecting abrasive particles through the opening along the length of the barrel onto workpieces passing through the barrel; and means for advancing the workpieces through the barrel, a portion of, the means for advancing the workpieces through the barrel being maintained stationary relative to the barrel, the means for advancing the workpieces engaging the barrel and oscillating the barrel such that workpieces disposed in the barrel are moved from the feed end to the exit end.

2. The apparatus of claim 1, wherein the means for rotating the barrel includes a ring circumferentially disposed about the barrel, the ring being in engagement with the barrel such that rotation of the ring causes the barrel to rotate, the means for rotating further including a drive motor having a selectively rotatable drive wheel, the drive wheel being in driving engagement with the ring.

3. The apparatus of claim 2, wherein the ring is connected to the barrel by means of a connection which permits relative axial movement between the ring and the barrel while preventing relative rotational movement between the ring and the barrel.

4. The apparatus of claim 3, wherein the connection between the ring and the barrel is provided by:

a plurality of longitudinally extending tracks included as part of a selected one of the ring or the barrel;

a plurality of rollers included as part of the other of the ring or the barrel, the rollers being in engagement with the tracks and having their axes of rotation disposed generally perpendicular to the longitudinal axis of the barrel.

5. The apparatus of claim 4, wherein the tracks are disposed on an inner diameter of the ring and the rollers are disposed on an outer diameter of the barrel.

6. The apparatus of claim 3, further comprising a means for permitting rotational movement of the ring while preventing axial movement of the ring.

7. The apparatus of claim 6, wherein the means for permitting rotational movement of the ring while preventing axial movement of the ring is in the form of a plurality of grooved rollers disposed about a circumference of the barrel and rotatable about axes disposed generally parallel to a longitudinal axis of the barrel, and a flange extending radially outwardly of the ring, the flange being in engagement with the grooved rollers.

8. The apparatus of claim 1, wherein the means for advancing the workpieces through the barrel includes a tube extending from one end of the barrel, the tube having an opening through which workpieces may pass, an actuator for oscillating the tube along an axis parallel to the longitudinal axis of the barrel, and a connection providing relative rotational movement between the tube and the actuator.

9. The apparatus of claim 8, wherein the tube is disposed at the exit end of the barrel.

10. The apparatus of claim 8, wherein the end of the tube is closed, a side opening in the tube permits workpieces to pass through the tube, and the connection between the tube and the actuator is in the form of a bearing connected to the closed end of the tube, and a clevis extending from the bearing.

11. The apparatus of claim 1, wherein the barrel has skeletal walls defining a plurality of openings along its length.

12. The apparatus of claim 1, wherein the barrel is trough-like and has an opening along its top.

13. The apparatus of claim 12, wherein the barrel includes bottom walls diverging at an angle of approximately 130 degrees and sidewalls extending generally vertically when the barrel is in a neutral position.

14. The apparatus of claim 13, wherein the barrel further includes intermediate walls interconnecting the bottom walls and sidewalls, and rails disposed along the upper edge of the sidewalls.

15. The apparatus of claim 12, further including means for limiting the rotational movement of the barrel to a clockwise and counterclockwise oscillation of the barrel.

16. The apparatus of claim 15, wherein the means for limiting includes bosses projecting outwardly of the barrel and a shock absorber engageable with the bosses.

17. The apparatus of claim 16, wherein the bosses and the shock absorber are positioned relative to each other such that the barrel is oscillated through an arc of approximately 120 degrees.

18. The apparatus of claim 15, further including a shield disposed about the barrel, the shield configured and arranged to catch any workpieces which may fall over the sides of the barrel.

19. The apparatus of claim 1, wherein the means for advancing workpieces through the barrel includes a ring connected to the barrel at one end of the barrel, an actuator for oscillating the ring along an axis parallel to the longitudinal axis of the barrel, and a connection providing relative rotational movement between the ring and the actuator.

20. The apparatus of claim 19, wherein the ring is disposed at the exit end of the barrel.

21. Apparatus for cleaning workpieces by the impingement of abrasive particles, comprising:

abrasive particle throwing means for projecting abrasive particles onto the workpieces;

means for supporting the workpieces for movement along a path of travel, the path of travel extending past the abrasive particle throwing means, the path of travel having a feed end and and exit end, the means for supporting the workpieces for movement along the path of travel being in the form of a generally horizonally oriented barrel having first and second open ends, the barrel having at least one opening along its length, the openings at the ends of the barrel permitting workpieces to enter and exit the barrel, and the opening along the length of the barrel permitting abrasive particles to be projected into the barrel;

a stationary support frame for holding the barrel;

means for rotating the barrel about a longitudinal axis of the barrel while workpieces are being moved through the barrel, the means for rotating the barrel being carried by the support frame; and means for advancing the workpieces along the path of travel, a portion of the means for advancing the workpieces along the path of travel being maintained stationary relative to the barrel, the means for advancing the workpieces engaging the means for supporting the workpieces and oscillating the means for supporting the worpieces in a single plane such that workpieces carried by the means for supporting are moved along the path of travel from the feed end to the exit end.

22. Apparatus for cleaning workpieces by the impingement of abrasive particles, comprising:

a generally horizontally oriented barrel having first and second ends, the barrel having at least one opening along its length, the barrel being open at both ends to define a feed end and an exit end, the openings at the ends of the barrel permitting workpieces to enter and exit the barrel, the opening along the length of the barrel permitting abrasive particles to be projected into the barrel;

means for rotating the barrel about a longitudinal axis of the barrel, the means for rotating the barrel including:

a ring circumferentially disposed about the barrel, the ring being in engagement with the barrel such that rotation of the ring causes the barrel to rotate;

a drive motor having a selectively rotatable drive wheel, the drive wheel being in driving engagement with the ring; and the ring being connected to the barrel by means of a connection which permits relative axial movement between the ring and the barrel while preventing relative rotational movement between the ring and the barrel, the connection between the ring and the barrel being provided by:

a plurality of longitudinally extending tracks included as part of a selected one of the ring or the barrel; and a plurality of rollers included as part of the other of the ring or the barrel, the rollers being in engagement with the tracks and having their axes of rotation disposed generally perpendicular to the longitudinal axis of the barrel;

abrasive particle throwing means disposed adjacent the barrel for projecting abrasive particles through the opening along the length of the barrel onto workpieces passing through the barrel; and means for advancing the workpieces through the barrel, the means for advancing the workpieces engaging the barrel and oscillating the barrel such that workpieces disposed in the barrel are moved from the feed end to the exit end.

23. The apparatus of claim 22, wherein the tracks are disposed on an inner diameter of the ring and the rollers are disposed on an outer diameter of the barrel.

24. Apparatus for cleaning workpieces by the impingement of abrasive particles, comprising:

a generally horizontally oriented barrel having first and second ends, the barrel having at least one opening along its length, the barrel being open at both ends to define a feed end and an exit end, the openings at the ends of the barrel permitting workpieces to enter and exit the barrel, the opening along the length of the barrel permitting abrasive particles to be projected into the barrel;

means for rotating the barrel about a longitudinal axis of the barrel, the means for rotating the barrel including:

a ring circumferentially disposed about the barrel, the ring being in engagement with the barrel such that rotation of the ring causes the barrel to rotate;

a drive motor having a selectively rotatably drive wheel, the drive wheel being in driving engagement with the ring; and the ring being connected to the barrel by means of a connection which permits relative axial movement between the ring and the barrel while preventing relative rotational movement between the ring and the barrel;

means for permitting rotational movement of the ring while preventing axial movement of the ring, said means being in the form of a plurality of grooved rollers disposed about a circumference of the barrel and rotatable about axes disposed generally parallel to a longitudinal axis of the barrel, and a flange extending radially outwardly of the ring, the flange being in engagement with the grooved rollers;

abrasive particle throwing means disposed adjacent the barrel for projecting abrasive particles through the opening along the length of the barrel onto workpieces passing through the barrel; and means for advancing the workpieces through the barrel, the means for advancing the workpieces engaging the barrel and oscillating the barrel such that workpieces disposed in the barrel are moved from the feed end to the exit end.

25. Apparatus for cleaning workpieces by the impingement of abrasive particles, comprising:

a generally horizontally oriented, trough-like barrel having first and second ends, the barrel having at least one opening along its top extending the length of the barrel, the barrel being open at both ends to define a feed end and an exit end, the openings at the ends of the barrel permitting workpieces to enter and exit the barrel, the opening along the top of the barrel permitting abrasive particles to be projected into the barrel;

means for rotating the barrel about a longitudinal axis of the barrel;

abrasive particle throwing means disposed adjacent the barrel for projecting abrasive particles through the opening along the top of the barrel onto workpieces passing through the barrel;

means for advancing the workpieces through the barrel, the means for advancing the workpieces engaging the barrel and oscillating the barrel such that workpieces disposed in the barrel are moved from the feed end to exit end; and means for limiting the rotational movement of the barrel to a clockwise and counterclockwise oscillation of the barrel, said means including bosses projecting outwardly of the barrel and a shock absorber engageable with the bosses.

26. The apparatus of claim 25, wherein the bosses and the shock absorber are positioned relative to each other such that the barrel is oscillated through an arc of approximately 120 degrees.

* * * * *